US005718272A

United States Patent [19]

Brazell

[11] Patent Number: 5,718,272

[45] Date of Patent: Feb. 17, 1998

[54] FACING SURROUND ASSEMBLY

[76] Inventor: David O. Brazell, 21400 Via Del Lobo, Yorba Linda, Calif. 92887

[21] Appl. No.: 800,500

[22] Filed: Feb. 14, 1997

Related U.S. Application Data

[60] Provisional application No. 60/011,797, Feb. 14, 1996.

[51] Int. Cl.[6] ..... E04F 10/00

[52] U.S. Cl. ..... 160/39; 160/DIG. 9

[58] Field of Search ..... 160/39, 38, 19, 160/31, DIG. 9, 84.06, 23.1, 133, 271, 273.1, 268.1, 172 R, 172 V; 126/544, 546, 547, 548, 551

[56] References Cited

U.S. PATENT DOCUMENTS

| | | | |
|---|---|---|---|
| 2,604,157 | 7/1952 | Gaetano | 160/9 |
| 2,958,378 | 11/1960 | Rubens | 160/19 |
| 3,077,923 | 2/1963 | Hatcher | 160/39 X |
| 3,818,891 | 6/1974 | Dew | 160/DIG. 9 |
| 4,095,852 | 6/1978 | Edwards | 160/DIG. 9 |
| 4,572,156 | 2/1986 | Lentz | 160/DIG. 9 |
| 4,974,658 | 12/1990 | Komatsu et al. | 160/264 X |
| 5,067,540 | 11/1991 | Besler | 160/31 |
| 5,609,196 | 3/1997 | Kraler | 160/323.1 |

*Primary Examiner*—David M. Purol
*Attorney, Agent, or Firm*—Owen J. Bates

[57] ABSTRACT

This facing surround assembly is provided which can be installed without fabrication in the field by anyone with average skills. The facing surround is generally made of non-combustible material and is generally used in conjunction with a fireplace or other wood burning appliance. The invention consists of two comer members, a horizontal header, two vertical support members attached together with the header located between the two corner blocks and the vertical support members being at right angles to the header, coplanar with the header and facing the same direction. The attachments are accomplished by adjustable members so that any one configuration of the invention can be used to construct a facing which could cover a number of different openings.

2 Claims, 6 Drawing Sheets

FACING SURROUND ASSEMBLY

A. CROSS REFERENCES

This application claims the benefit of U.S. Provisional Application No. 60/011,797 filed on Feb. 14, 1996.

B. TECHNICAL ASPECTS OF THE INVENTION

This invention relates primarily to factory-built surround facing systems generally suitable for providing a non-combustible, safe, and easily installed surround, typically for factory-built fireplaces and vented decorative gas appliances or other locations in which a decorative non-combustible surround assembly can be used. This invention, which can be sculptured, painted or patterned and manufactured of non-combustible material, offers a superior method of providing an esthetic, functional, and easily installed alternative to the traditional materials of brick, tile, marble and other similar materials. This invention incorporates a method of adjustment in a factory-built packaged surround that allows a package to fit a wide range of sizes of fireplace, appliance or other openings which is easily installed with standard hand tools and without curing in the field.

C. BACKGROUND OF INVENTION

The area around a fireplace opening, which is usually surfaced with noncombustible natural materials, such as brick or tile, is generally referred to as a surround or facing. A surround is generally thought of as providing an aesthetic or decorative enhancement that compliments or accents the room decor. The surround has a functional purpose as well. The surround or facing provides a non-combustible protective area around the fireplace opening which serves as a safety zone, isolating normal combustible building materials from the heat and flames emanating from the fireplace opening. Most of the traditional noncombustible materials are installed by specialized tradesmen that possess the, skills of applying these materials to surfaces around a fireplace opening. When used as currently described, the invention would be manufactured of non-combustible material. However, when installed for purely decorative purposes, the invention can be made of many other materials.

Traditional materials, such as tile or brick, are very labor intensive to install, because there are a number of individual pieces that must be handled and installed. In addition, there is a high degree of training and experience needed to install these natural materials in a competent and aesthetic manner. The task is complicated because of the large number of pieces that must be preciously aligned on the installation surface in both the vertical and horizontal planes. Further, the traditional materials are heavy and are prone to breakage both during transport and installation. There is a need for an invention that would provide a modular substitution for the traditional materials and methods. The invention would have to be easy to assemble and install by lay persons who possess a basic knowledge of hand tool use. Complete packaging would make it much easier to inventory, store and transport without the traditional breakage and space required by traditional materials. The invention offers a great benefit to new and existing installations in the residential housing markets. Mobile and modular homes are also desirable markets for this product. This invention is most closely related to factory-built metal fireplaces and factory-built decorative gas appliances in that the invention is often constructed from materials similar to that used in the manufacturer of the fireplaces and appliances. The installation of the invention requires many of the same skills as those that are required to assemble and install fireplaces and appliances. Thus, the same workmen who are installing the fireplace or appliance could also install the surround, eliminating the need to hire and schedule an additional crew of workmen.

D. OBJECTS OF THE INVENTION

The invention provides a solution to a number of deficiencies in the use of traditional materials and methods of constructing surrounds. Several objectives are achieved by this invention. First, it provides a fireplace/appliance facing surround assembly that can be easily put together and installed. Second, it provides for adjustment in a horizontal and vertical direction so that the final assembly will fit a wide range of sizes of front open fireplaces, appliances and other openings. By using a standard configuration, such that only three pieces need to have varying lengths, it is possible to accommodate a wide range of fireplace or appliance sizes or other openings. Third, the need to modify the adjacent wall structure, beyond that required for the fireplace or appliance, is eliminated. Additionally the invention can be manufactured to mimic the appearance of many natural materials used for facings and thus the invention can be made to accommodate a wide range of decors. In addition, all mounting fasteners and hardware are hidden from view after installation, thus additionally enhancing its visual appeal.

A further object of the invention, is that it is equally suitable for both retro fitting firing as well as new installations. Factory-built fireplaces and appliances are normally installed within conventional combustible framing. The adjacent finished wall surfaces are traditionally installed so that their surfaces are flush with he fireplace/appliance front black faces. For an existing installation where traditional materials have been installed, removing these existing materials is necessary and any slight damage to the wall surfaces will normally be covered by the newly installed metal facing material. With new installations, the finished wall surfaces need only be prepared as they would be when applying traditional materials. The proper installation of this invention relies on the adjacent wall surfaces to be flush with the fireplace/appliance front facing, which is the same requirement as for traditional materials.

With the preceding objectives in mind, the corner blocks, top covers, vertical support panels, header panels and sleeves can be provided completely finished in a wide variety of style, texture, finish and color. All the necessary hardware, which includes the adjustable mounting brackets, lower retaining brackets, necessary assembly and attachment hardware and assembly and installation instructions can be provided in one single carton, which is packaged to ensure complete protection of the contents and ease contents of handling, inventory, and storing.

E. DESCRIPTION OF DRAWINGS

To provide a more thorough understanding of the invention in addition to illustrating additional details and advantages thereof, reference is now made to the following detailed descriptions along with the accompanying drawings, in which.

FIG. 1 is a perspective view of the assembled surround.

FIG. 1*a* is perspective view of the lower left hand corner of the facing surround assembly and a portion of the wall and fireplace.

Figure 3:
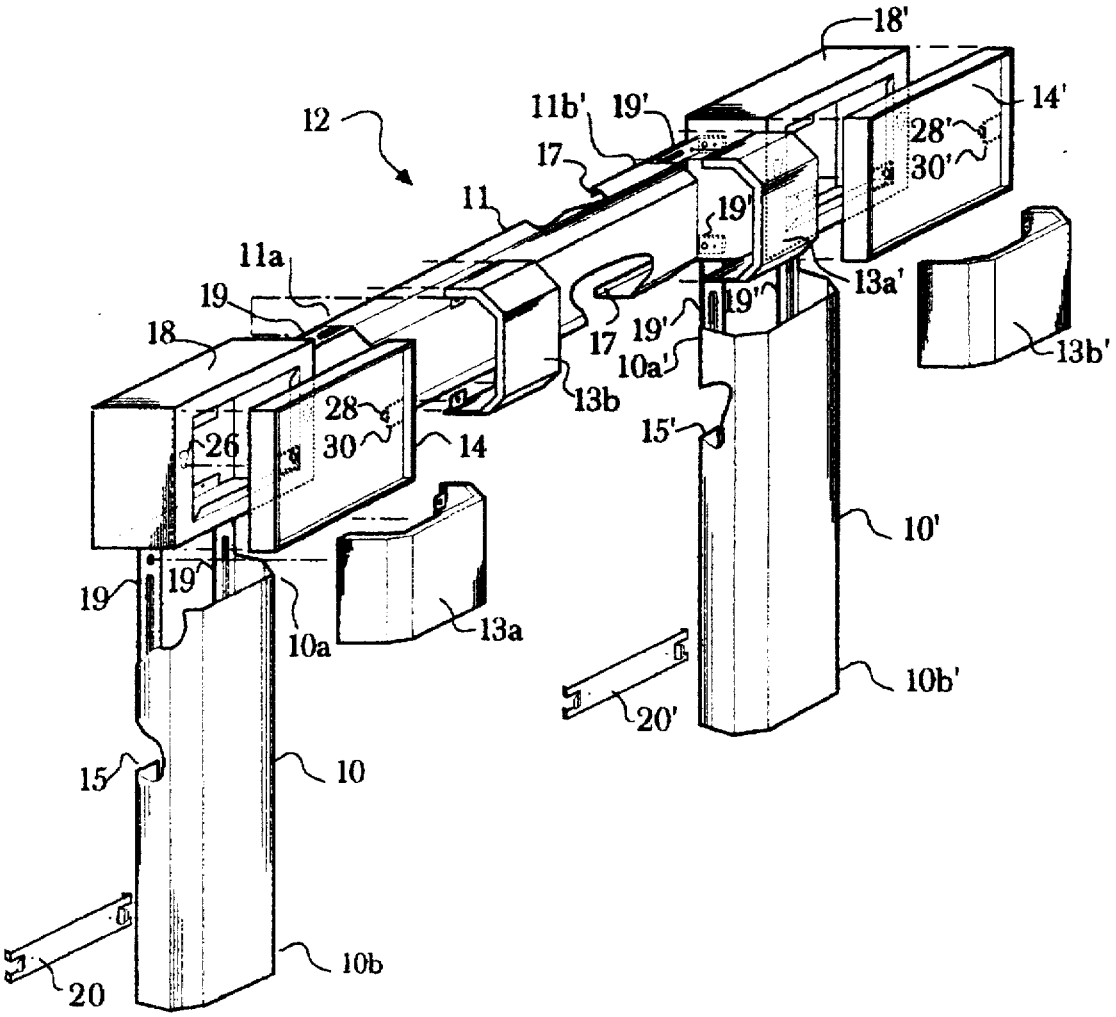
FIG. 3 is an exploded view of the facing surround assembly from the front.
Figure 3A:
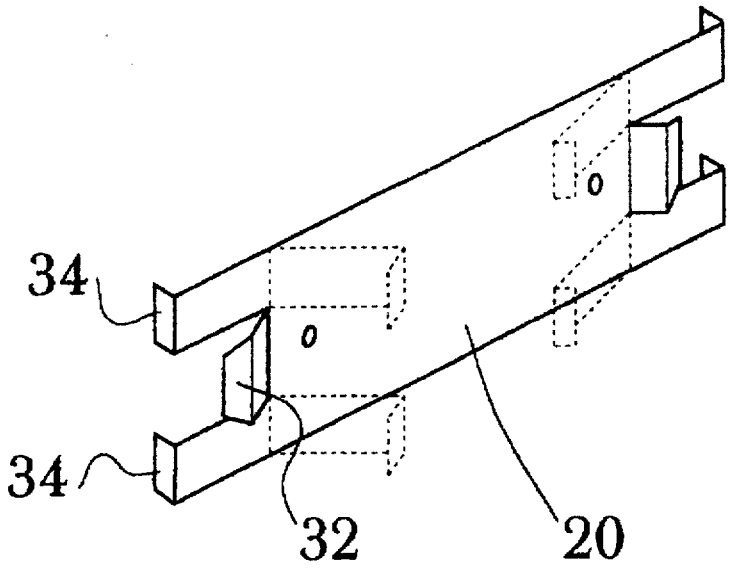

FIG. 3*a* is an enlarge view of the lower retention bracket 20 showing the aligning tabs and the retention tab.

Figure 3B:
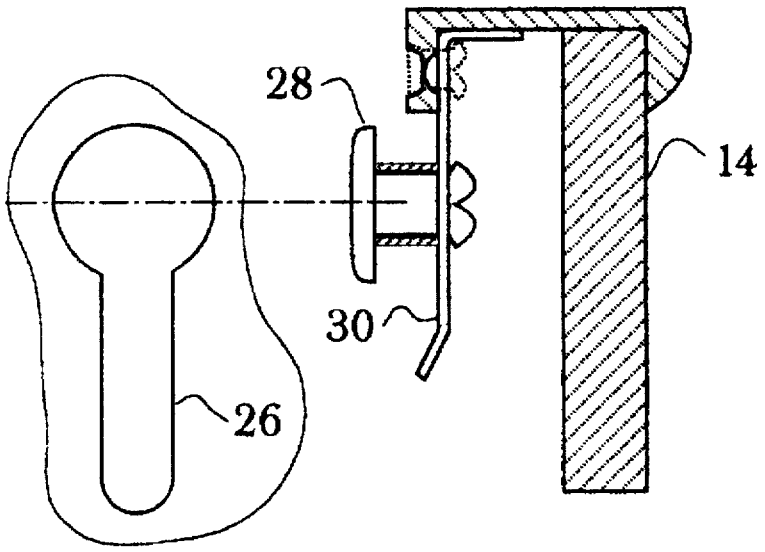

FIG. 3*b* is side view of the cover locking pins and spring

F. INSTALLATION OF THE INVENTION

This assembly process details the installation of the preferred embodiment. Other embodiments of the invention, which might possess different components, would have different installation instructions. Though reference is made to the use of machine screws and nuts, any number of other attachment devices can be used.

Initially reference shall be made to FIG. 3. The assembly process begins by attaching the angled end of all eight upper adjustment brackets 19 to both left and right corner members 18,18'. The upper adjustment brackets 19 are L-shaped brackets with a shorter end having one hole for attachment to the corner members 18,18' and a longer arm having a long slotted adjustment hole located at the end of the arm and a single circular hole near the angle for the attachment of the sleeves. The corner members have a four slotted holes designed to receive the upper adjustment brackets by inserting the long end of the upper adjustment bracket through the slotted hole from inside the corner member. The shorter arm of the upper adjustment bracket is then positioned flat against the inside surface of the corner member and the long arm is now extended perpendicularly away from the surface of the corner member. The upper adjustment bracket is then secured in place by passing a screw through the corner member and through the hole on the short arm of the upper adjustment bracket and securing with a nut. The slotted ends of the upper adjustment brackets 19 can then be loosely attached to the ends of the header panel 11 and the upper ends of the vertical support members **10*a*,10*a*'. This attachment is done in the following manner. Each header panel and each vertical support member has a pair of flanges 15 running on each side of the header panel and each side of the vertical support member for the length the header panel and the length of the vertical support member. There is a hole in each flange 15 positioned near the upper end of the vertical support members 10*a*, 10*a*' and near the left and right ends of the header panel 11*a*, 11*b*'. The attachment is made by passing a machine screw through the flange hole 15*a*, and then through the slotted hole in each upper adjustment bracket and securing with a nut. Both the horizontal spacing between the vertical support members 10,10' and the vertical height of the header panel 11 can then be adjusted to accommodate the width and height of the fireplace, appliance or other opening. Once the adjustments have been determined, the vertical support members 10,10' and the header panel 11 can then be fully tightened onto the upper adjustment brackets 19**.

The lower brackets 20,20' can now be attached to the lower portion of the fireplace or appliance opening. Reference is now being made to FIG 1*a*. The lower brackets 20,20' are positioned by placing the aligning tab 34 which is at one end of the lower bracket against the edge of the fireplace opening. As an example, if the lower bracket for the left side of the opening is being positioned, the lower bracket 20 is placed so that the right hand aligning tab extends just past and around the left hand edge of the fireplace. Then the bracket pulled snugly to the left, hooking the aligning tab 34 on the edge of the fireplace or other opening. The lower brackets were designed so that if the above procedure is followed, that vertical support members 10,10' will be properly positioned horizontally in relation to the rest of the surround 12, once the vertical support members are held in place by the lower retaining bracket 20. The lower retaining bracket 20 is now attached to the wall with included hardware. Lower retaining bracket 20' is attached in an similar fashion.

After the brackets 20,20' have been installed, each aligning tab 34 is bent back on itself through a 135 degree angle. This alteration of the lower bracket 20,20' provides clearance for the vertical support members 10,10' and permits the aligning tabs 34 to be hidden from view after the vertical support members 10,10' have been installed.

Figure 1:
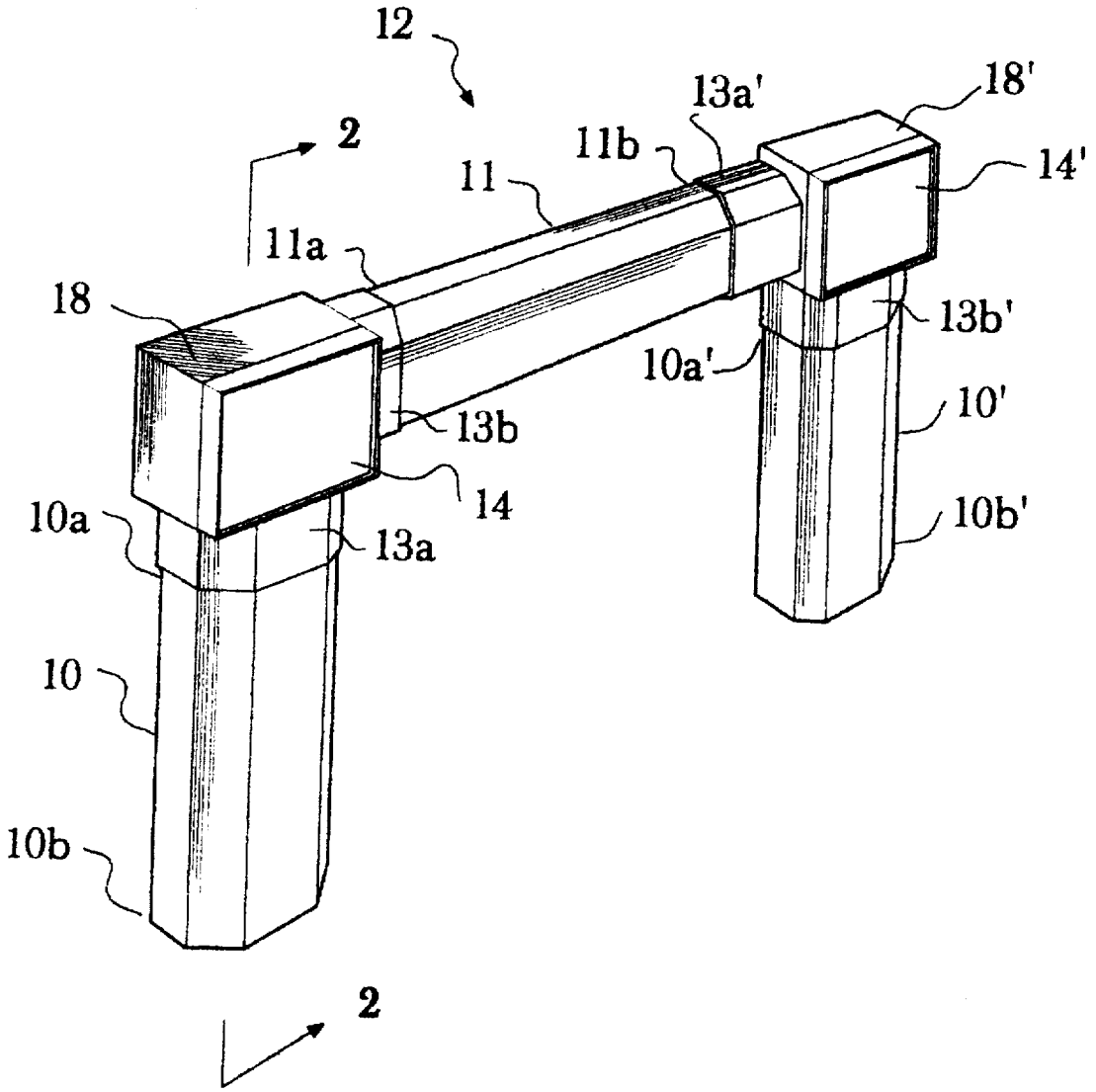
Figure 1A:
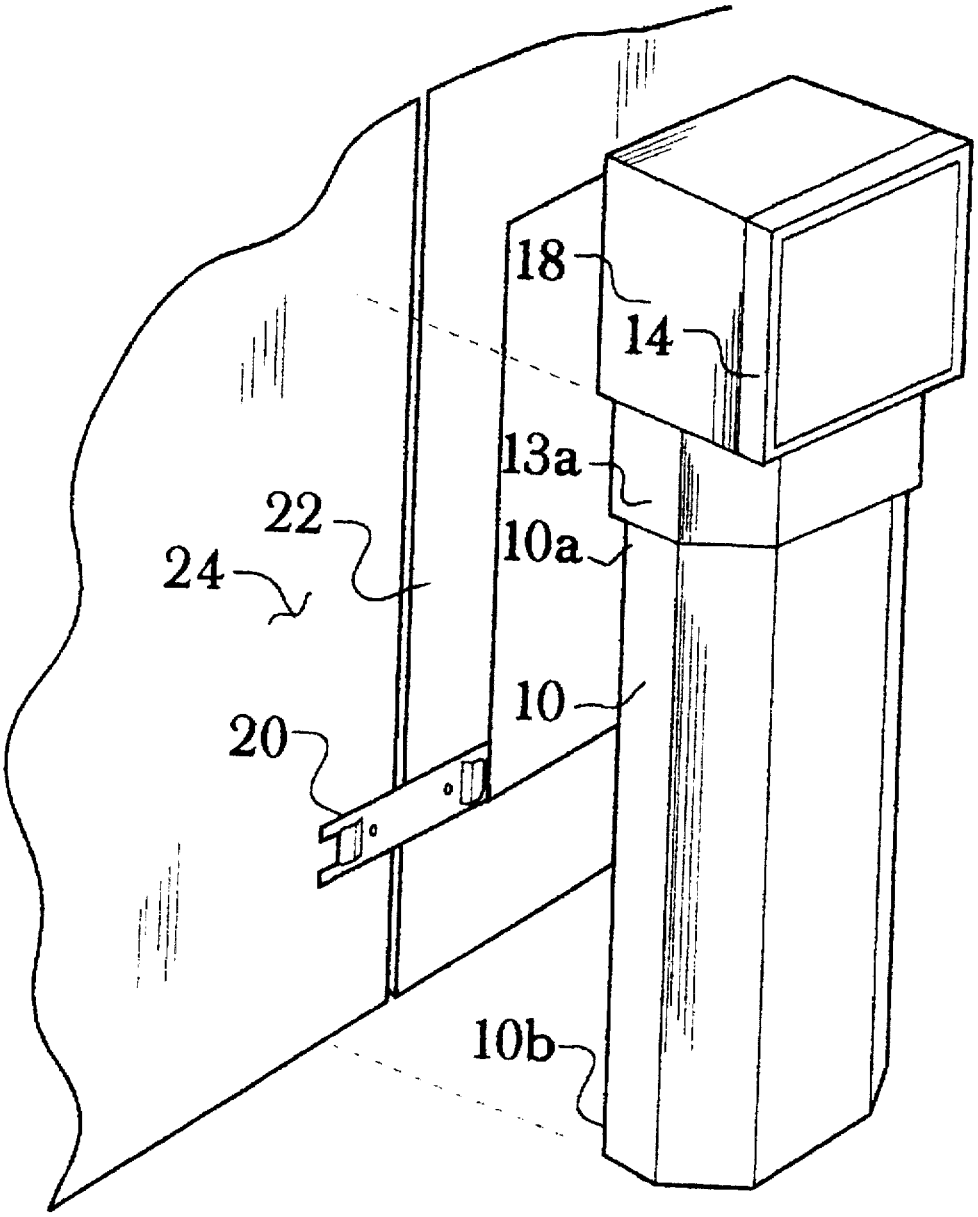

With reference now being made to FIG. 1, all four sleeves **13*a*, 13*a*', 13*b*, 13*b*' are now attached to the eight upper adjustment brackets 19 using the provided hardware. In a manner similar to the attachment of the header panel, there is a tab with a hole on the inside surface of each sleeve. A machine screw is passed through a hole in the upper adjustment bracket 19, through the hole in the tab and secured by a matching nut. The invention is designed so that there is some gap between the corner members 18,18' and either the header panel 11 and the corner members 18,18' and the vertical support members 10,10'. The size of the gap will change based upon the exact opening for which the surround 12** is being installed.

The purpose of the sleeves **13*a*, 13*a*', 13*b*,13*b*' is two fold. The first is to provide a smooth visual transition from the corner block to either the header panel or the vertical support panels. The second is to hide the upper adjustment brackets 19. In this embodiment of the invention, the sleeves come in two types: 13*a*,13*a*' and 13*b*,13*b*'**. Because in this embodiment the sleeves are tapered so that the outside edge of the sleeve is taller then the inside edge, the sleeves are not interchangeable.

This completed assembly can now be positioned around the fireplace, appliance or other opening and secured to the fireplace facing and wall by means of screws passed through holes in flanges provided inside the comer members 18,18' and then screwed into the wall or fireplace facing. The lower portion of the flanges 15 located on each side of the vertical supports panels **10*b*,10*b*' are inserted under the retaining tab 32 on the lower brackets 20, 20'. Retaining tabs 32 hold the vertical support members 10,10'** tight against the wall surfaces.

Lastly each of the two top covers 14,14' are attached to the faces of the corners members 18,18' and held in place by engaging the two locking pins 28 on each of the top covers 14,14' within the two keyhole slots 26 on the face of each of the corner member 18,18'. Spring 30 provides tension to keep locking pin 28 firmly in position against the keyhole slot 26.

G. DETAILED DESCRIPTION OF THE PREFERRED EMBODIMENT

An adjustable fireplace surround, hereinafter referred to as Surround 12, will best be described initially by reference to FIG. 1 which shows fully assembled, one possible configuration of the invention. Several important features of the invention are not visible from this view, but will be shown and discussed later in this description. The Surround 12 is shown as it would be viewed from inside a room looking into the fireplace or other opening. Starting in the from the lower left hand corner, FIG. 1 shows a left vertical support member 10. Positioned at the upper portion of the left vertical support member 10 is a sleeve **13*a*. The upper portion of sleeve 13*a* abuts the lower portion of left corner member 14. Positioned on an adjacent face of left corner member 14 is sleeve 13***b* which abuts the right hand face of left corner member 18. Cover 14 is attached to the outward facing surface of corner member 18. Positioned next to sleeve 13*b* is header 11. On the opposite side of header 11 is sleeve 13*a*', which abuts the left hand face of right corner member 18'. Cover 14' is attached to one face of corner member 18'. Sleeve 13*b*' is positioned so that the flat upper surface of sleeve 13*b*' abuts the lower surface of corner member 18'. Right vertical support member 10' is position below sleeve 13*b*' and in contact with sleeve 13*b*'.

It should be understood that various shapes and configurations shown are not the only possible embodiment of the invention. For example, the corner members could take on a variety of shapes, including but not limited to: hexagonal, oval, oblong or even round and still be within the scope and spirit of the invention. The top covers, as shown are rather simple covers, but they could be surfaced in any number of ornamental ways. The header and vertical support members can be made so that their shapes takes on a variety of contours and textures in order to blend with a wide range of decorating styles.

Figure 2:
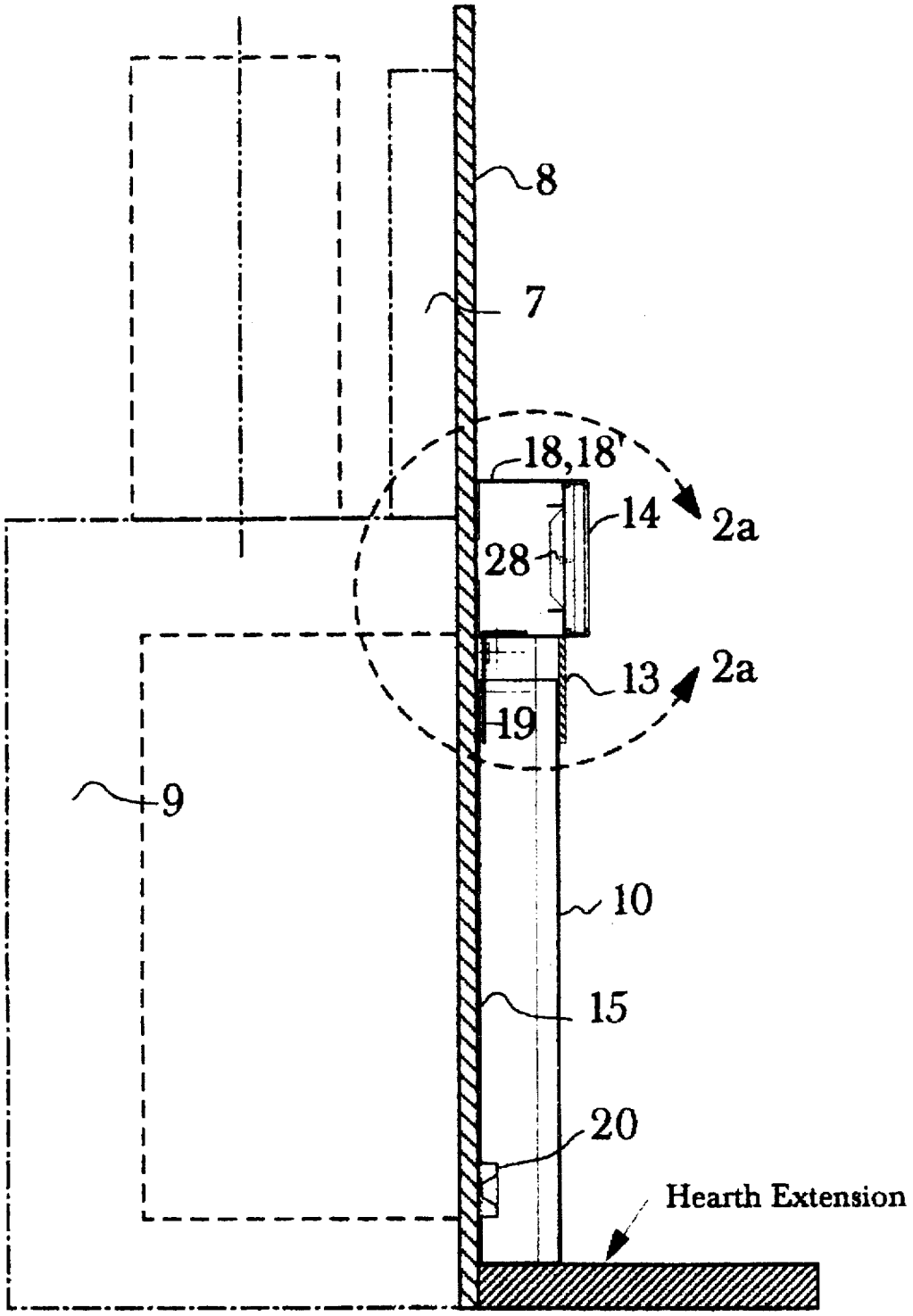
FIG. 2 is a cross sectional view along plane 2—2 as shown in FIG. 1. An enlarged detail of the upper portion of the facing surround assembly is also shown.
Figure 2A:
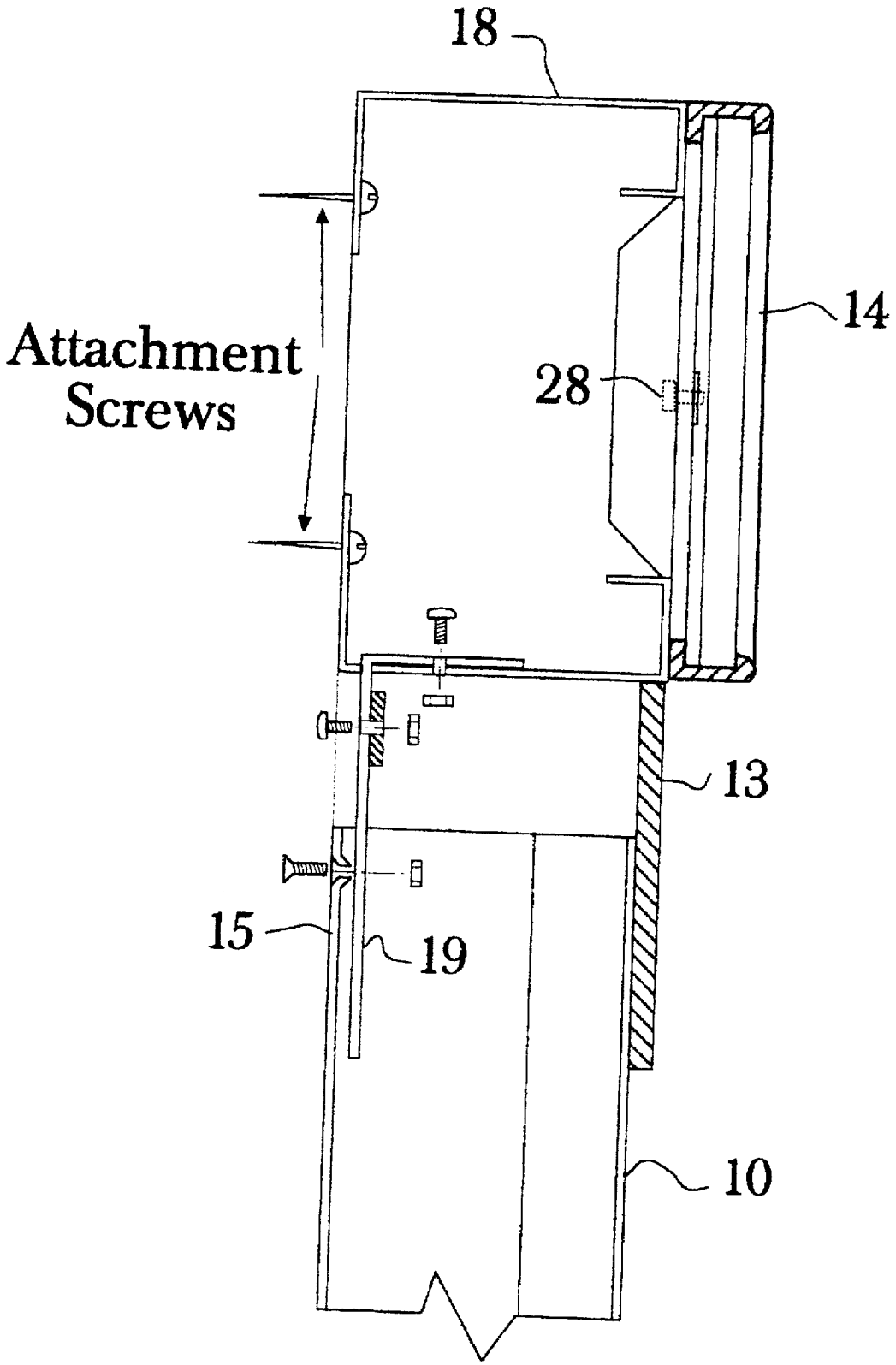

FIG. 2 is a sectional view along plane 2—2 as shown in FIG. 1. The fireplace appliance 9, the front enclosure wall 8 and supporting framing 7 though not part of the invention, are shown in order to better describe the relationship between the invention and the fireplace. Starting in the lower portion of FIG. 2, is the lower retaining bracket 20, which is attached to either the front enclosure wall 8 or to a portion of the fireplace appliance 9. Vertical support member 10 has a inward turning flange 15 running the length of the vertical support member on each side. The vertical support member 10 is retained by the flange 15, which is described in detail later in this application. Sleeve 13 is located at the upper end of the vertical support member 10 and abuts the lower surface of the corner block 18. Sleeve 13 is secured to upper adjustment bracket 19. Upper adjustment bracket 19 is passed through a slot in the body of corner block 18 and held securely by a machine screw and nut, passing through a hole in the upper adjustment bracket 19 and the corner block 18. Top cover 14 is attached to corner member 18 by use &locking pins 28 which engage keyhole slots in corner block 18.

FIG. 3 is an exploded view of the Surround 12. Starting the description in the lower left corner with the lower retaining member 20, which is attached near the floor, just to the left of the fireplace opening. The left vertical support member 10, has two flanges 15 which run along the longitudinal axis and are turned in so that once the left vertical support member 10 is installed, the flanges 15 are not visible. The flanges 15 are engaged in retaining clips that are integral with lower retaining member 20. The upper portion of left vertical support member 10 is attached by machine screws and nuts to a pair of upper adjustment members 19. The upper adjustment members 19 are L-shaped with one leg longer than the other. The longer leg has an oblong adjustment hole near the end and a circular hole located between the oblong hole and the corner bend. The short arm of the upper adjustment bracket 19 has a circular hole in the middle of the short arm. The left vertical support member 10 is secured to the upper adjustment brackets by passing a machine screw through each oblong hole in each upper adjustment bracket through a hole 15*a* in the flange 15 of the vertical support member 10 and engaging a matching nut. The sleeve 13*a* is secured to a hole in upper adjustment bracket 19 by way of a two tabs each with a hole mounted on opposite sides of the sleeve 13*a*. A machine screw is passed through the hole in the tab and through the hole in the upper adjustment bracket 19 and secured by a nut. Sleeve 13*a* overlaps a portion of vertical support member 10 and abuts the lower surface of corner member 18. Cover 14 attaches to corner member 18 by engaging a pair of locking pins 28 into keyhole slots 26.

A pair of upper adjustment brackets are attached in the manner previously described to the right hand face of corner block 18. Sleeve 13*b* and horizontal panel 11 are attached to upper adjustment brackets in a manner to similar to that already described. The right end of the header panel, 11*b*' is attached to a pair of upper adjustment brackets that have been attached to corner block 18' in the manner previously described.

A pair of upper adjustment brackets are attached to the lower surface of corner block 18' in the manner previously described. Sleeve 13*b*' and vertical support member 10' attached to the upper adjustment brackets in the manner previously described.

FIG. 3*a* shows one end of lower retaining bracket 20. The tabs 34 are used to help locate the lower retaining bracket by placing the hooked ends around the edge of a fireplace or other opening. After the lower retaining bracket has been positioned, it is screwed into place. The tabs 34, of which there are four on each lower retaining bracket, are bent back through approximately a 135 degree rotation. This clears the tabs 34 from interference with other components and permits the vertical support members 10,10' to be placed such that the flange on these items engages the retaining clip 32 on lower retaining bracket 20.

FIG. 3*b* shows locking pin 28 as it is located on an inner surface of top cover 14. Locking pin 28 is mounted on a spring 30. Locking pin 28 engages keyhole slots 26 in the front surface of corner members 18, 18'. The spring 30 maintains pressure on the locking pin 28 to help secure the top cover 14 when it is in place.

Although preferred embodiments of the invention have been described in the foregoing. Detailed Description and illustrated in the accompanying drawings, it will be understood that the invention is not limited to the embodiments disclosed but is capable of numerous rearrangements modifications and substitutions of parts and elements without departing from the spirit the invention. Accordingly, the present invention is intended to encompass such rearrangements, modifications of parts and elements as within the spirit and scope of this invention. Even though the invention has been described primarily as being used in conjunction with a fireplace opening, the invention may equally be used to provide a decorative and/or protective surround for a doorway, archway, windows or any other opening.

I claim:

1. An apparatus for surrounding an opening comprising:

a) a horizontal header having two ends;

b) a first pair of adjustable engagement means attached to said ends of said horizontal header;

c) a pair of corner members attached to said first pair of adjustable engagement means such that said horizontal header is located between said corner members wherein the distance between said corner members is adjustable;

d) a second pair of adjustable engagement means, one each attached to said pair of corner members such that said first pair of adjustable engagement means is orthogonal to said second pair of adjustable engagement means; and e) a pair of vertical support members having an upper end and a lower end, such that said upper end of said vertical support members is removably attached to said second pair of adjustable engagement means wherein said vertical support members and said horizontal header are coplanar and the distance between said lower end of said vertical support members and said corner members is adjustable.

2. An apparatus as described in claim 1 wherein the apparatus is made of non-combustible material.

* * * * *